US009556764B2

(12) United States Patent
Claywell et al.

(10) Patent No.: US 9,556,764 B2
(45) Date of Patent: Jan. 31, 2017

(54) INDIVIDUAL PISTON SQUIRTER SWITCHING WITH CRANKANGLE RESOLVED CONTROL

(71) Applicant: GM Global Technology Operations LLC, Detroit, MI (US)

(72) Inventors: Mark R. Claywell, Birmingham, MI (US); Bryan K. Pryor, Waterford, MI (US); Mojtaba Eshraghi, Farmington Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 14/276,336

(22) Filed: May 13, 2014

(65) Prior Publication Data

US 2015/0330286 A1 Nov. 19, 2015

(51) Int. Cl.

| | |
|---|---|
| ***F01M 1/08*** | (2006.01) |
| ***F01P 3/08*** | (2006.01) |
| ***F02F 3/22*** | (2006.01) |

(52) U.S. Cl.

CPC . *F01M 1/08* (2013.01); *F01P 3/08* (2013.01); *F02F 3/22* (2013.01)

(58) Field of Classification Search

CPC ..... F01P 3/06; F01P 3/08; F01P 7/00; F01P 7/14; F01P 2007/146; F02F 3/20; F02F 3/22; F01M 1/08; F01M 1/14; F01M 1/16; F01M 11/02; F01M 2001/083

USPC ..... 123/41.35, 196 R

See application file for complete search history.

(56) References Cited

U.S. PATENT DOCUMENTS

| | | | | |
|---|---|---|---|---|
| 3,709,109 | A * | 1/1973 | Howe | F01P 3/08 123/41.35 |
| 4,667,630 | A * | 5/1987 | Sasaki | F01P 3/08 123/254 |
| 4,864,977 | A * | 9/1989 | Hasegawa | F02D 15/02 123/48 B |
| 4,979,473 | A * | 12/1990 | Lee | F01P 3/08 123/41.35 |
| 5,819,692 | A * | 10/1998 | Schafer | F01P 3/08 123/41.35 |
| 6,298,810 | B1 * | 10/2001 | Chimonides | F01P 3/08 123/41.35 |
| 6,955,142 | B2 * | 10/2005 | Patel | F01M 1/08 123/196 S |
| 7,249,577 | B1 * | 7/2007 | Zhang | F01M 1/06 123/41.35 |
| 8,408,167 | B2 * | 4/2013 | Ko | F02F 3/16 123/184.22 |

(Continued)

FOREIGN PATENT DOCUMENTS

| | | | | |
|---|---|---|---|---|
| GB | 2431219 B | * | 9/2011 | F01M 1/08 |
| JP | 06101473 A | * | 4/1994 | F01P 3/08 |

*Primary Examiner* — Grant Moubry

(74) *Attorney, Agent, or Firm* — BrooksGroup

(57) ABSTRACT

One variation may include a product comprising a piston oil squirting system comprising at least one piston oil squirter operatively communicating with at least one engine oil channel and which is constructed and arranged to squirt oil at at least one piston; and at least one mechanism which is constructed and arranged to control a flow rate and a timing of at least one oil jet stream from the at least one piston oil squirter so that the oil jet stream flows at single or multiple intervals from a zero to a maximum flow rate within an engine cycle or a crankshaft revolution.

22 Claims, 9 Drawing Sheets

(56) References Cited

U.S. PATENT DOCUMENTS

| | | | | |
|---|---|---|---|---|
| 8,746,193 | B2 * | 6/2014 | Bowler | F01M 1/16<br>123/41.35 |
| 9,068,497 | B2 * | 6/2015 | Anderson | F01M 1/08 |
| 9,074,516 | B2 * | 7/2015 | Perotto | F01P 3/10 |

* cited by examiner

INDIVIDUAL PISTON SQUIRTER SWITCHING WITH CRANKANGLE RESOLVED CONTROL

TECHNICAL FIELD

The field to which the disclosure generally relates to includes engines.

BACKGROUND

An engine may include one or more pistons.

SUMMARY OF ILLUSTRATIVE VARIATIONS

A number of variations may include a product comprising: a piston oil squirting system comprising: at least one piston oil squirter operatively communicating with at least one engine oil channel and which is constructed and arranged to squirt oil at at least one piston; and at least one mechanism which is constructed and arranged to control a flow rate and a timing of at least one oil jet stream from the at least one piston oil squirter so that the oil jet stream flows at single or multiple intervals from a zero to a maximum flow rate within an engine cycle or a crankshaft revolution.

Another variation may include a method comprising: controlling the timing and instantaneous flow rate of at least one oil jet stream from at least one piston oil squirter so that the oil jet stream flows at single or multiple intervals from a zero to a maximum flow rate during an engine cycle and timing the instantaneous flow rate relative to an individual piston position.

Other illustrative variations within the scope of the invention will become apparent from the detailed description provided hereinafter. It should be understood that the detailed description and specific examples, while disclosing variations within the scope of the invention, are intended for purposes of illustration only and are not intended to limit the scope of the invention.

BRIEF DESCRIPTION OF THE DRAWINGS

Select examples of variations within the scope of the invention will become more fully understood from the detailed description and the accompanying drawings, wherein.

DETAILED DESCRIPTION OF ILLUSTRATIVE VARIATIONS

The following description of the variations is merely illustrative in nature and is in no way intended to limit the scope of the invention, its application, or uses.

Figure 8:
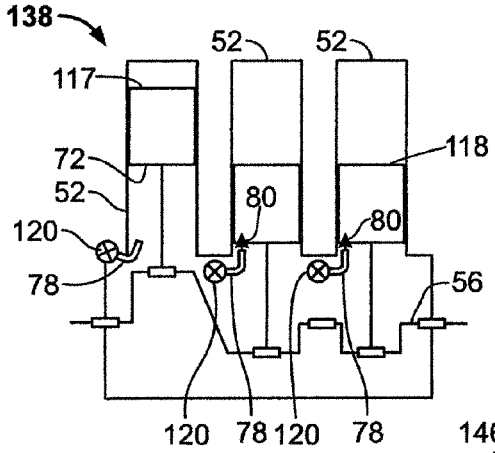
FIG. 8 illustrates a schematic of an engine with piston oil squirters according to a number of variations.
Figure 9:
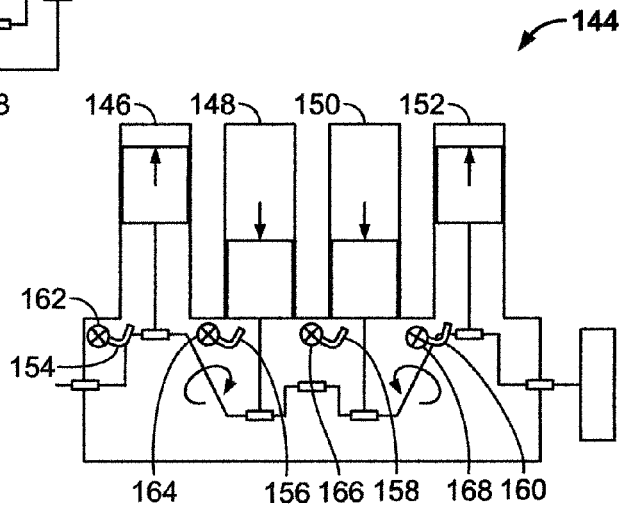
FIG. 9 illustrates a schematic of an engine with piston oil squirters according to a number of variations.
Figure 10:
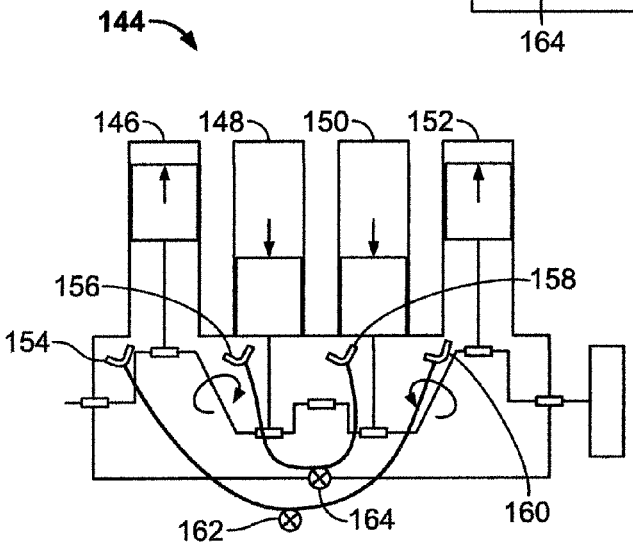
FIG. 10 illustrates a schematic of an engine with piston oil squirters according to a number of variations.

Referring to FIGS. 8-10, in a number of variations, any number of engines, 138, 144, may include one or more cylinders 52 which may each include a piston 54. The one or more pistons 54 may move upward to top dead center 117, for example as illustrated in FIG. 8, and downward to bottom dead center 118, for example as illustrated in FIG. 8, during any of a number of cycles which may drive the crankshaft 56. As the one or more pistons 54 move upward and downward during each cycle, heat may be generated in the cylinder 52. In a number of variations, oil 58 may be squirted into and/or onto the underside 72 of a piston 54 to dissipate heat which may be generated from combustion and/or friction which may result between the piston 54 and the cylinder 52 as the piston 54 travels between top dead center 117 to bottom dead center 118.

Figure 1:
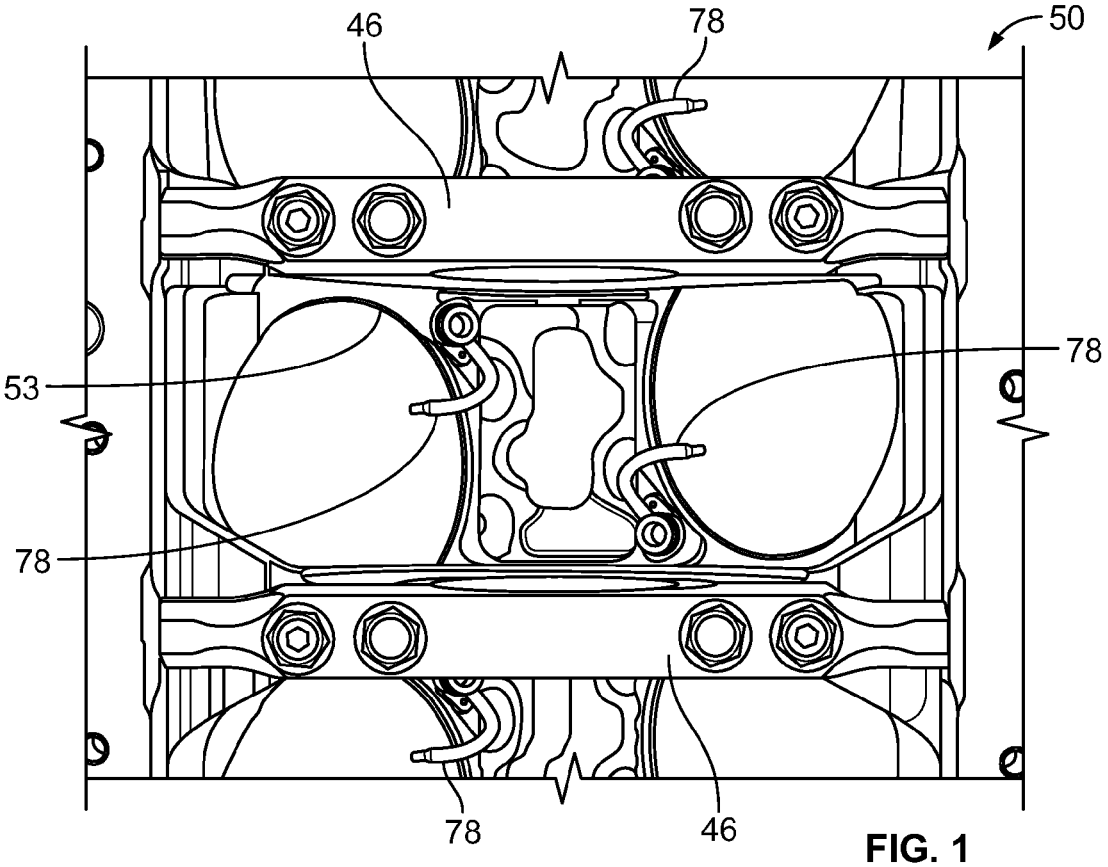
FIG. 1 illustrates a bottom view of an engine with piston oil squirters according to a number of variations.
Figure 2:
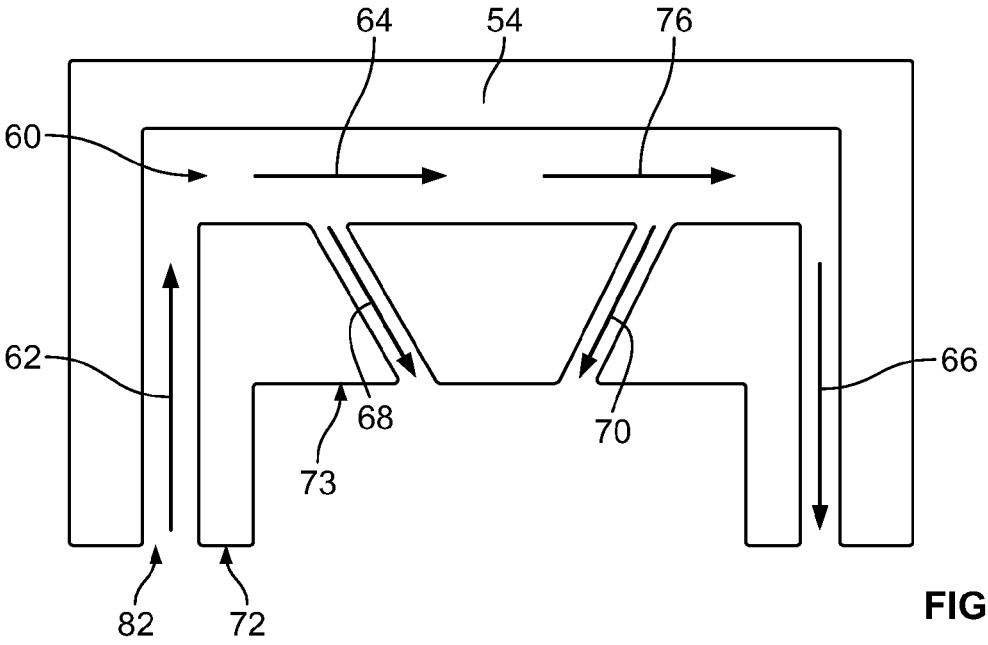
FIG. 2 illustrates a schematic of a piston with a plurality of piston oil galleries according to a number of variations.
Figure 3:
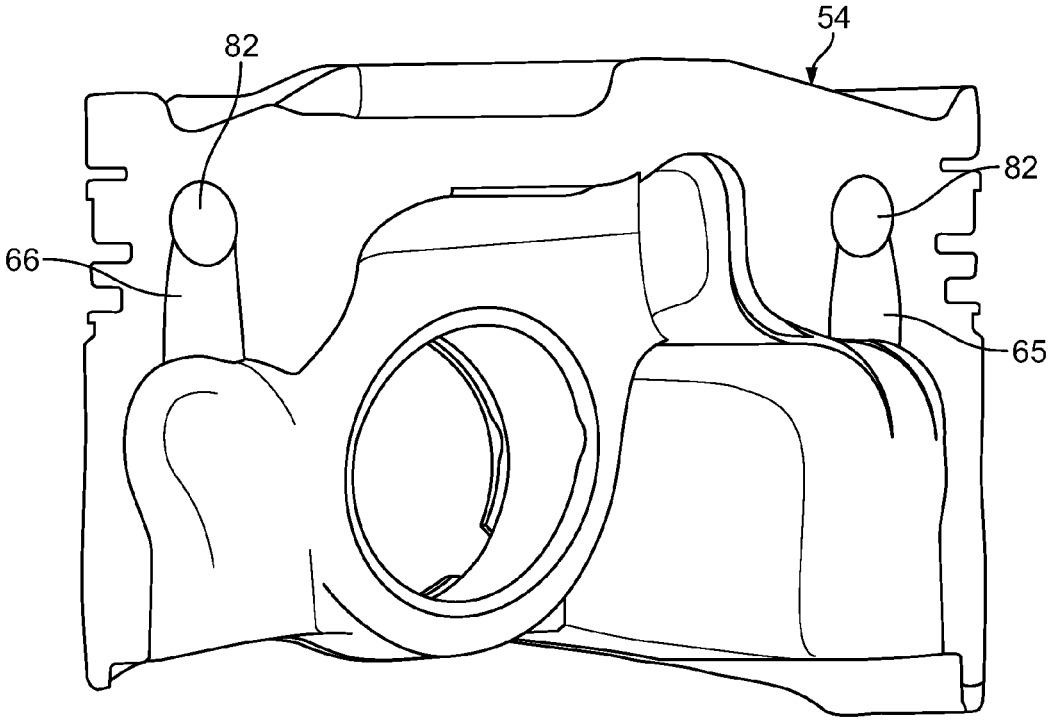
FIG. 3 illustrates a cut view of a piston according to a number of variations.

Referring to FIGS. 1-3 and 8, in a number of variations, a piston 54 may be solid, for example as illustrated in FIG. 8, or may include one or more oil galleries 60, for example as illustrated in FIGS. 2-3. In one variation, an oil gallery 60 may comprise an inlet channel 62, a body channel 64, and one or more outlet channels 66, 68, 70. The inlet channel 62 may comprise a number of shapes including, but not limited to, cylindrical, and may extend upward substantially perpendicular from the underside 72 of the piston 54. The body channel 64 may extend from the end 74 of the inlet channel 62 and may comprise a number of shapes including, but not limited to, a ring or torus shape, and may extend around the inner body 76 of the piston 54. An outlet channel 66, 68, 70 may be any of a number of shapes including, but not limited to, cylindrical in shape. One or more outlet channels 66, 68, 70 may extend from the body channel 64. In one variation, a first outlet channel 66 may extend vertically from the body channel 64 approximately parallel with the inlet channel 62. A second outlet channel 68 may extend from the body channel 64 at an angle inward toward the center of the piston bowl 73. A third outlet channel 70 may extend at an angle approximately opposite with the second outlet channel 68 angle to the piston bowl 73. In a number of variations, a piston oil squirter 78 may be positioned adjacent the underside 72 of the piston 54 near the bottom of the piston bore 53 and may be attached to an engine block 44 or integrated into the bulkhead 46 of the engine block 44, for example as illustrated in FIG. 1. In another variation, a piston oil squirter 78 may be positioned adjacent and/or in line with an inlet oil gallery hole 82. In a number of variations, the piston oil squirter 78 may squirt an oil jet stream 80 into the piston oil gallery hole 82. The oil 58 may then travel through one or more oil gallery channels 62, 64, 66, 68, 70 within the piston 54 which may help to dissipate heat, which may be generated from the pistons 54 moving through the cylinders 52 during each engine cycle, to the oil 58. The upward and downward motion of the piston 54 may further cause the oil 58 to travel through the one or more piston oil gallery channels 62, 64, 66, 68, 70 and further dissipate heat.

Figure 4:
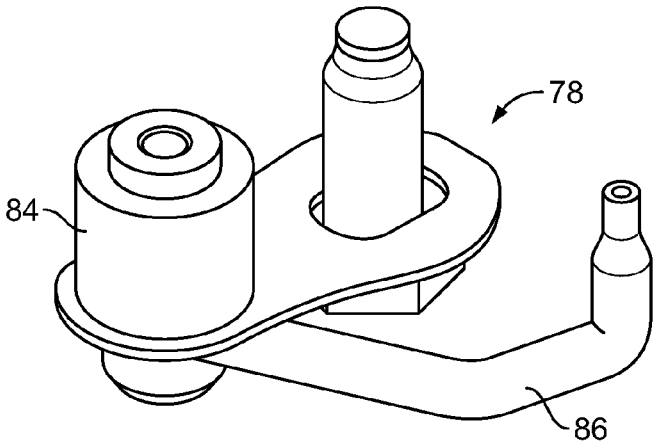
FIG. 4 illustrates a prospective view of a piston oil squirter according to a number of variations.

Referring to FIG. 4, in a number of variations, a piston oil squirter 78 may comprise a body 84 and a nozzle 86. The body 84 may be constructed and arranged to transport oil 58 from an oil passage 48 to the nozzle 86.

In a number of variations, one or more mechanisms 120, 274, 278, 290, 298 may be provided which may allow one or more piston oil squirter oil jets streams 80 to be turned on/off so that the flow may go from zero to a maximum flow rate which may allow the oil flow to occur at single or multiple intervals during each engine cycle. In a number of variations, the piston oil squirters 78 may be timed so that each piston oil squirter 78 squirts oil 58 for only for a portion of a crank rotation during an engine cycle.

Figure 5:
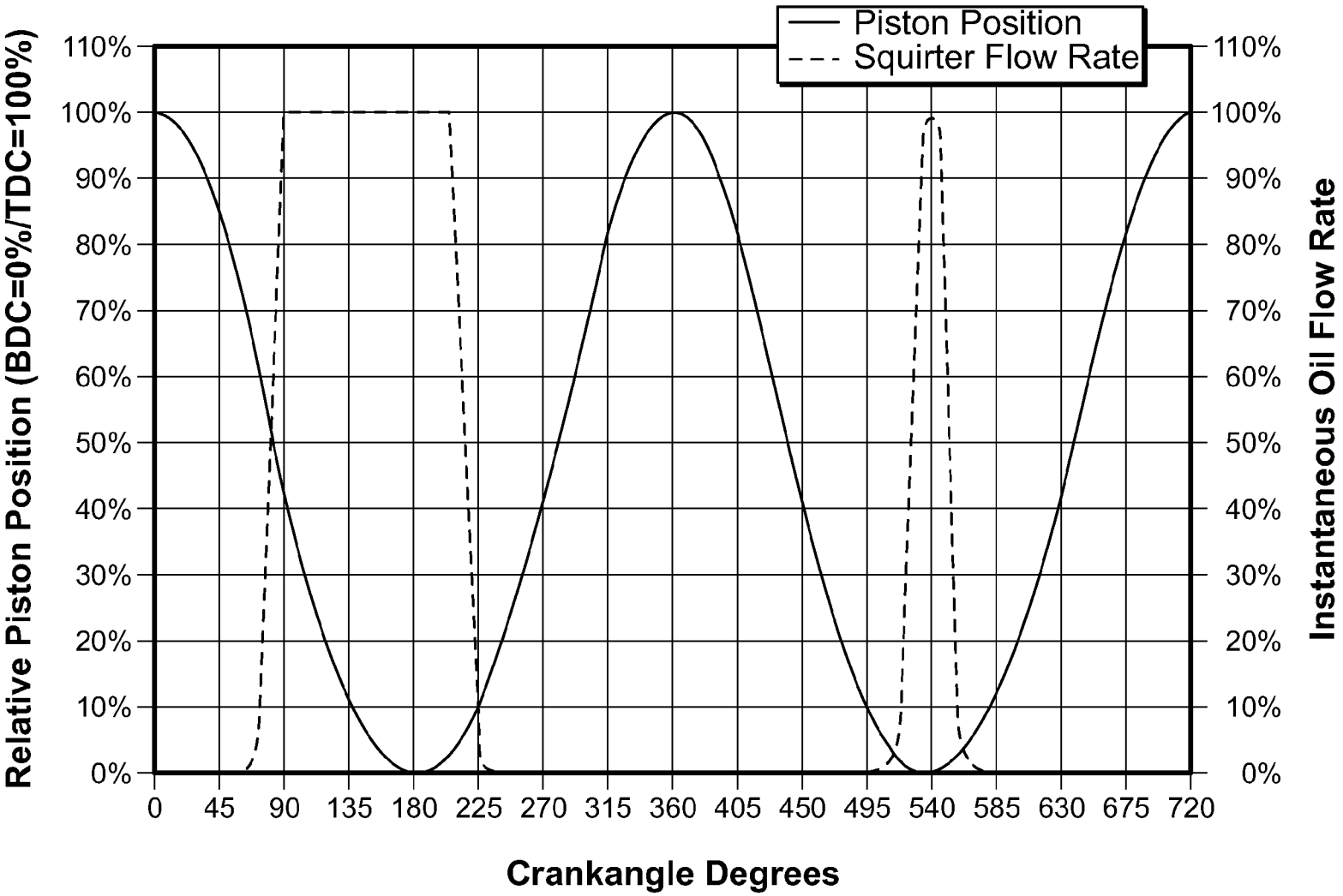
FIG. 5 illustrates a graph illustrating a variation of a squirter flow rate according to a number of variations.

In a number of variations, the piston oil squirter 78 cycle-averaged oil flow rate may be controlled to vary in a continuous fashion based on any combination of load, rpm, and/or oil temperature. In a number of variations, a piston oil squirter 78 average oil flow rate may be determined based on the following equation:

$$\text{Average flow rate}=K*\%\ \text{Duty}*\text{Static Flow Rate},$$

wherein the average flow rate is the flow rate delivered to the piston oil squirter 78 by the oil pump, wherein K is a constant, nominally close to 1, but may be adjusted by a table to account for flow non-linearities, wherein % Duty is the percent on-time over a cycle or revolution, and wherein the Static Flow Rate is the static flow rate of the piston oil squirter 78 (equivalent to the flow rate at 100% duty cycle). In a number of variations, a piston oil squirter 78 may expel multiple different cycle-averaged flow rates of oil at different intervals within an engine cycle or crankshaft revolution, for example as illustrated in FIG. 5. In a number of variations, the timing of the piston squirter jet streams 80 may allow for instantaneous oil flow at optimal intervals which may maintain heat transfer at the same level while decreasing the total cycle-averaged oil flow. In another variation the piston squirter 78 may be constructed and arranged to have a high instantaneous flow rate and the piston oil squirter 78 may be timed to squirt at any number of intervals and may be timed to stop at any number of intervals which may increase overall heat transfer while decreasing the cycle-averaged oil flow. In a number of variations, an optimal interval for instantaneous oil flow may occur while the piston 54 is traveling downward toward bottom dead center 118 which may increase the relative velocity between the piston 54 and oil jet stream 80. As the relative velocity between the piston 54 and the oil jet stream 80 is increased, the instantaneous rate of oil flow into the oil gallery 62 may be increased by optimizing the timing of when the oil squirter 78 is turned on during the cycle. This may cause an increase in heat transfer.

Further, timing the piston oil squirter 78 to squirt oil 58 into the piston 54 at a maximum flow rate as the piston 54 moves closer to bottom dead center 118, for example as illustrated in FIG. 8, may improve accuracy of the oil jet stream 80 reaching its target of the piston oil gallery hole 82 as the diameter of the oil jet stream 80 may increase as the piston 54 is farther away from the piston oil squirter 78.

Figure 6:
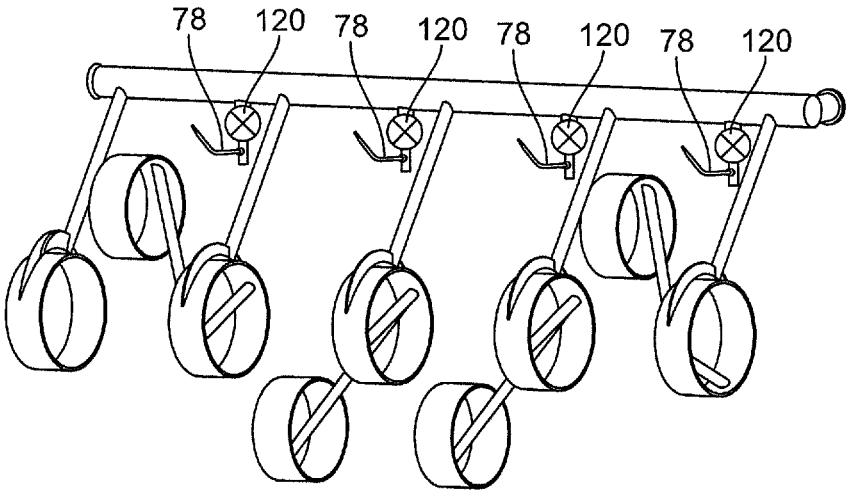
FIG. 6 illustrates a prospective view of a plurality of piston oil squirters with individual solenoids operatively coupled therewith according to a number of variations.

In a number of variations, one or more solenoids 120 may be used to control the timing and/or instantaneous oil flow rate of the one or more piston oil squirters 78. In one variation, each individual piston oil squirter 78 may be operatively coupled to its own solenoid 120, for example as illustrated in FIG. 6. This may allow the instantaneous oil flow rate of each oil jet stream 80 from each oil squirter 78 to be controlled independently of the other piston oil squirters 78.

Figure 7:
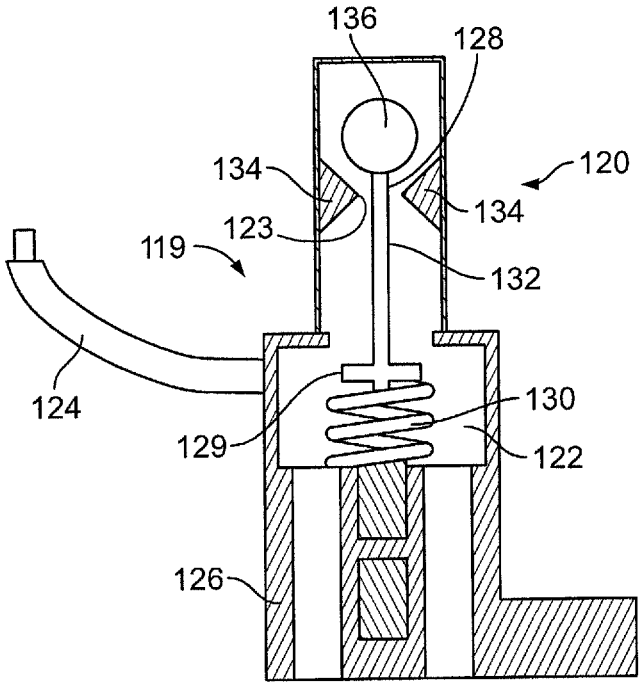
FIG. 7 illustrates a schematic of an integrated piston oil squirter and solenoid according to a number of variations.

In another variation, a solenoid valve 120 may be integrated into the piston oil squirter 119, for example as illustrated in FIG. 7. In a number of variations, an integrated piston oil squirter 119 may comprise a body 122 and a nozzle 124. The body 122 may comprise a housing 126 and a solenoid valve 120. In a number of variations, the solenoid valve 120 may comprise a coil 130, a ball stem 132, a ball seat 134, and a ball 136. The ball stem 132 may comprise a first end 128 and a second end 129. The first end 128 may be operatively coupled to the ball 136 and the second end 129 may be operatively coupled to the coil 130. The ball 136 may be adjacent a ball seat 134. The coil 130 may pull the ball stem 132 downward which may cause the ball 136 to be seated in the ball seat 134 which may prevent oil 58 from passing through the body 122 including through orifice 123, into the nozzle 124. The coil 130 may also push the ball stem 132 upward away from the ball seat 134 which may allow oil 58 to pass through the body 122 into the nozzle 124.

In a number of variations, one or more solenoid valves 120 may be used to control one or more piston oil squirters 78 in a number of variations of engines 50 including, but not limited to, an inline 3 engine 138, an inline 4 engine 144, or a V8 engine 174, 224 or other type of engine to control the timing of the piston oil squirters 78 depending on the engine specifications. In a number of variations, any number of pistons 54 which may reach bottom dead center 118 at or approximately at the same time may be grouped together and controlled by the same solenoid 120.

Referring to FIG. 8, in a number of variations, an inline 3 engine 138 may include three cylinders 52. Each cylinder 52 may include its own piston oil squirter 78. Each piston oil squirter 78 may be operatively coupled to its own mechanism including, but not limited to, an individual solenoid 120 which may be used to control the velocity and/or timing of an oil jet stream 80.

Referring to FIG. 9, in a number of variations, an inline 4 engine 144 may include a first cylinder 146, second cylinder 148, third cylinder 150, and a fourth cylinder 152. In a number of variations, each piston oil squirter 154, 156, 158, 160 may be operatively coupled to its own mechanism including, but not limited to, an individual solenoid 162, 164, 166, 168, which may be used to control the velocity and/or timing of each oil jet stream 80. In a number of variations, a first piston oil squirter 154 may be adjacent or near the first cylinder 146, a second piston oil squirter 156 may be adjacent the second cylinder 148, a third piston oil squirter 158 may be adjacent the third cylinder 150, and a fourth piston oil squirter 160 may be adjacent the fourth cylinder 152. In one variation, the first piston oil squirter 154 may be operatively coupled to a first solenoid 162, the second piston oil squirter 156 may be operatively coupled to a second solenoid 164, the third piston oil squirter 158 may be operatively coupled to a third solenoid 166, and the fourth piston oil squirter 152 may be operatively coupled to a fourth solenoid 168.

Referring to FIG. 10, in another variation, the first piston oil squirter 146 and fourth piston oil squirter 152 may be operatively coupled to a first solenoid 162 and the second and third piston oil squirters 148, 150 may each be operatively coupled to a second solenoid 164 and may each be used to control the timing and/or velocity of the flow of the oil jet stream 80. In one variation, the first group of piston oil squirters 78 may be timed to squirt oil at a maximum instantaneous flow rate when a first group of pistons 54 approach approximately bottom dead center 118 and a zero flow rate when the first group of pistons 54 reach top dead center 117. The second group of piston oil squirters 148, 150 may also be timed to squirt oil 58 at a maximum instantaneous flow rate when a second group of pistons 54 approach approximately bottom dead center 118 and a zero flow rate when the pistons 54 reach top dead center.

Figure 11:
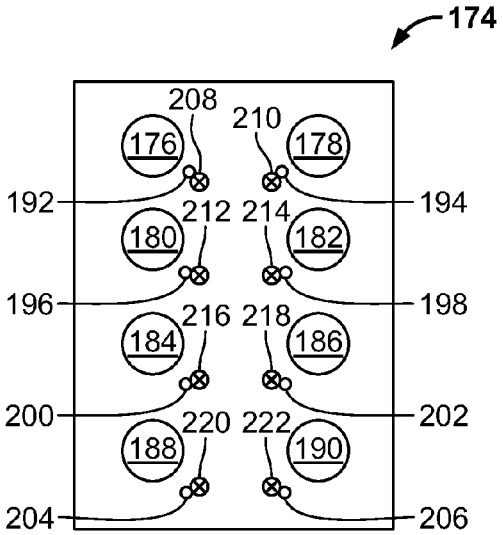
FIG. 11 illustrates a schematic of an engine with piston oil squirters according to a number of variations.

Referring to FIG. 11, in a number of variations, a V8 engine may comprise a cross-plane crankshaft and may include a first, second, third, fourth, fifth, sixth, seventh, and eighth cylinder 176, 178, 180, 182, 184, 186, 188, 190. A first piston oil squirter 192 may be adjacent the first cylinder 176, a second piston oil squirter 194 may be adjacent the second cylinder 178, a third piston oil squirter 196 may be adjacent the third cylinder 180, a fourth piston oil squirter 198 may be adjacent the fourth cylinder 182, a fifth piston oil squirter 200 may be adjacent the fifth cylinder 184, a sixth piston oil squirter 202 may be adjacent the sixth cylinder 186, a seventh piston oil squirter 204 may be adjacent the seventh cylinder 188, and an eighth piston oil squirter 206 may be adjacent the eighth cylinder 190. In a number of variations, each piston oil squirter 192, 194, 196, 198, 200, 202, 204, 206 may be operatively coupled to its own mechanism including, but not limited to, an individual solenoid 208, 210, 212, 214, 216, 218, 220, 222 which may be used to independently control the velocity and/or timing of each oil jet stream 80 coming from each piston oil squirter 192, 194, 196, 198, 200, 202, 204, 206.

Figure 12:
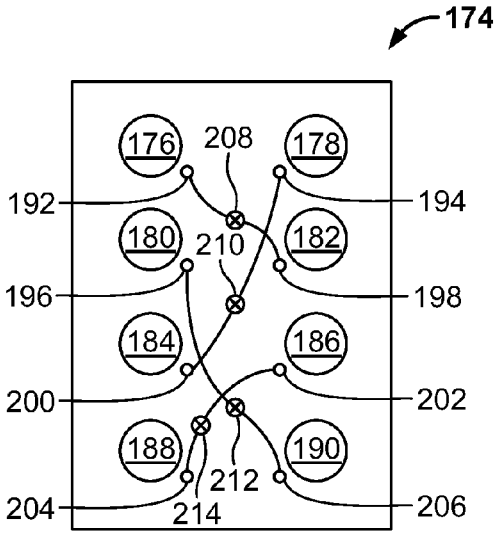
FIG. 12 illustrates a schematic of an engine with piston oil squirters according to a number of variations.

Referring to FIG. 12, in another variation, a V8 engine comprising a cross-plane crankshaft may include a first, second, third, and fourth solenoid 208, 210, 212, 214 which may each be used to control four pairs of piston oil squirters 192, 198, 194, 200, 196, 206, 202, 204. In one variation, a first solenoid 208 may be operatively coupled to both the first and fourth piston oil squirter 192, 198, a second solenoid 210 may be operatively coupled to both the second and fifth piston oil squirter 194, 200, a third solenoid 212 may be operatively coupled to the third and eighth piston oil squirter 196, 206, and a fourth solenoid 214 may be operatively coupled to the sixth and seventh piston oil squirter 202, 204. In a number of variations, each solenoid 208, 210, 212, 214 may be used to independently control the timing and/or velocity of each oil jet stream 80 coming from each pair of piston oil squirters 192, 198, 194, 200, 196, 206, 202, 204.

Figure 13:
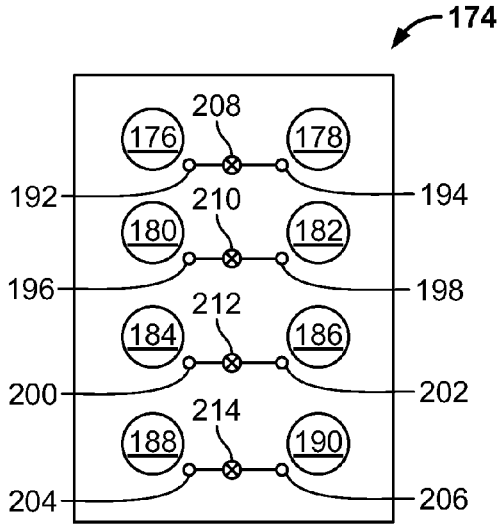
FIG. 13 illustrates a schematic of an engine with piston oil squirters according to a number of variations.

Referring to FIG. 13, in another variation, a V8 engine comprising a cross-plane crankshaft may include a first solenoid 208 operatively coupled to both the first and second piston oil squirter 192, 194, a second solenoid 210 operatively coupled to both the third and fourth piston oil squirter 196, 198, a third solenoid 212 operatively coupled to the fifth and sixth piston oil squirter 200, 202, and a fourth solenoid 214 operatively coupled to the seventh and eighth piston oil squirter 204, 206. In a number of variations, each solenoid 208, 210, 212, 214 may be used to independently control the timing and/or velocity of each oil jet stream 80 coming from each pair of piston oil squirters 192, 194, 196, 198, 200, 202, 204, 206.

Figure 14:
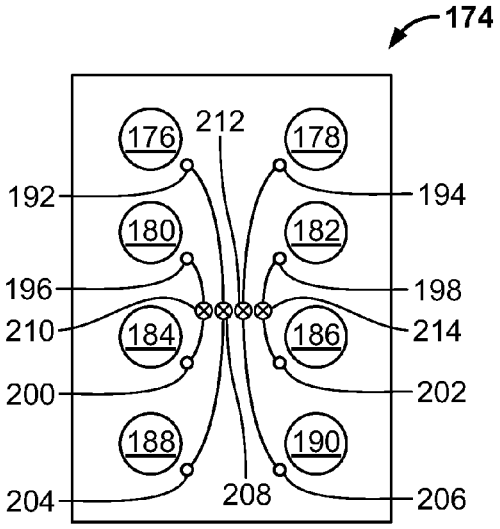
FIG. 14 illustrates a schematic of an engine with piston oil squirters according to a number of variations.

Referring to FIG. 14, in another variation, a V8 engine comprising a cross-plane crankshaft may include a first solenoid 208 operatively coupled to both the first and seventh piston oil squirter 192, 204, a second solenoid 210 operatively coupled to both the third and fifth piston oil squirter 196, 200, a third solenoid 212 operatively coupled to the second and eighth piston oil squirter 194, 206, and a fourth solenoid 214 operatively coupled to the fourth and sixth piston oil squirter 198, 202. In a number of variations, each solenoid 208, 210, 212, 214 may be used to independently control the timing and/or velocity of each oil jet stream 80 coming from each pair of piston oil squirters 192, 204, 196, 200, 194, 206, 198, 202.

Figure 15:
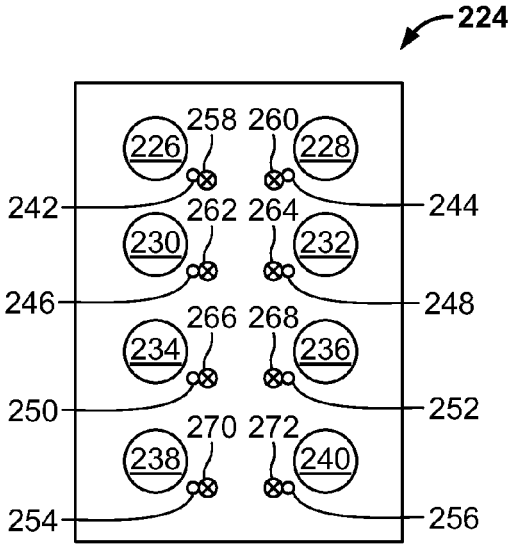
FIG. 15 illustrates a schematic of an engine with piston oil squirters according to a number of variations.

Referring to FIG. 15, in a number of variations, a V8 engine may comprise a flat-plane crankshaft and may include a first, second, third, fourth, fifth, sixth, seventh, and eight cylinder 226, 228, 230, 232, 234, 236, 238, 240. A first piston oil squirter 242 may be adjacent the first cylinder 226, a second piston oil squirter 244 may be adjacent the second cylinder 228, a third piston oil squirter 246 may be adjacent the third cylinder 230, a fourth piston oil squirter 248 may be adjacent the fourth cylinder 232, a fifth piston oil squirter 250 may be adjacent the fifth cylinder 234, a sixth piston oil squirter 252 may be adjacent the sixth cylinder 236, a seventh piston oil squirter 254 may be adjacent the seventh cylinder 238, and an eighth piston oil squirter 256 may be adjacent the eighth cylinder 240. In one variation, each piston oil squirter 242, 244, 246, 248, 250, 252, 254, 256 may be operatively connected to its own mechanism including, but not limited to, an individual solenoid 258, 260, 262, 264, 266, 268, 270, 272 which may be used to control the timing and/or velocity of each oil jet stream 80 coming from each piston oil squirter 242, 244, 246, 248, 250, 252, 254, 256.

Figure 16:
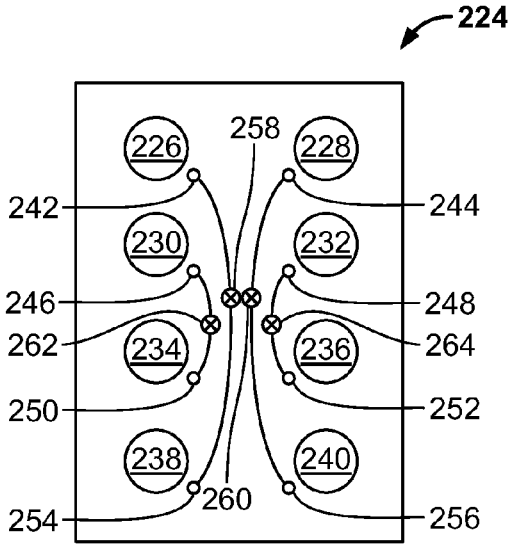
FIG. 16 illustrates a schematic of an engine with piston oil squirters according to a number of variations.

Referring to FIG. 16, in another variation, a V8 engine comprising a flat-plane crankshaft may include a first, second, third, and fourth solenoid 258, 260, 262, 264 which may be used to control four pairs of piston oil squirters 242, 254, 244, 256, 246, 250, 248, 252. In one variation, a first solenoid 258 may be operatively coupled to both the first and seventh piston oil squirter 242, 254, a second solenoid 260 may be operatively coupled to both the second and eighth piston oil squirter 244, 256, a third solenoid 262 may be operatively coupled to the third and fifth piston oil squirter 246, 250, and a fourth solenoid 264 may be operatively coupled to the fourth and sixth piston oil squirter 248, 252. In a number of variations, each solenoid 258, 260, 262, 264 may be used to independently control the timing and/or velocity of each oil jet stream 80 coming from each pair of piston oil squirters 242, 254, 244, 256, 246, 250, 248, 252.

Figure 17:
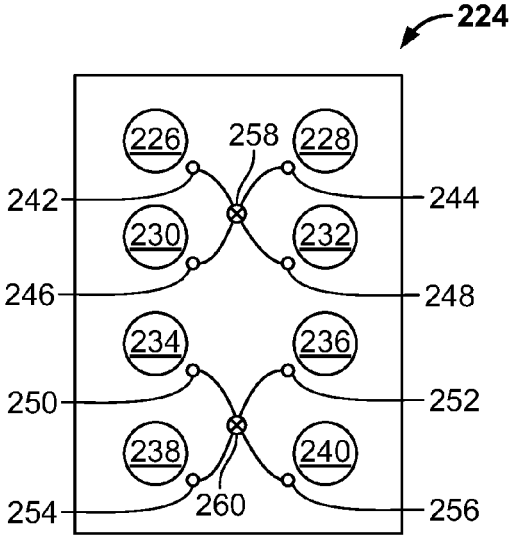
FIG. 17 illustrates a schematic of an engine with piston oil squirters according to a number of variations.

Referring to FIG. 17, in another variation, a V8 engine comprising a flat-plane crankshaft may include a first and second solenoid 258, 260 which may be used to control a first group of piston oil squirters 242, 244, 246, 248 and a second group of piston oil squirters 250, 252, 254, 256. The first solenoid 258 may be operatively coupled to each of the first, second, third, and fourth piston oil squirters 242, 244, 246, 248 and may be used to control the velocity and/or timing of the oil jet streams 80 coming from the piston oil squirters 242, 244, 246, 248. The second solenoid 260 may be operatively coupled to each of the fifth, sixth, seventh, and eighth piston oil squirters 250, 252, 254, 256 and may be used to control the velocity and/or timing of the oil jet streams 80 coming from the piston oil squirters 250, 252, 254, 256.

Figure 18:
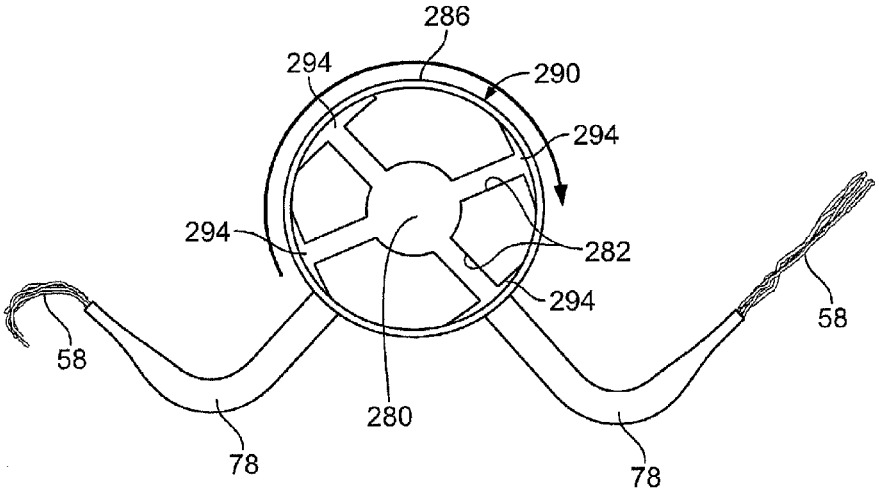
FIG. 18 illustrates a sectional view of a mechanical oil distributor according to a number of variations.

Referring to FIG. 18, in another variation, a mechanical distributor may be used to control the timing and/or velocity of the oil jet stream 80 coming from the piston oil squirter 78. In one variation, one or more rotating shafts 290 in the engine including, but not limited to, the camshaft, may include one or more grooves 294 which may be constructed and arranged to feed oil 58 to each piston oil squirter 78 at predetermined set intervals. In a number of variations, the oil 58 may flow through an oil feed 280 which may send oil 58 through an orifice that may include one or more channels 282 which may be formed in the shaft 290 and may include a groove 294 at the end 296 of the channel 282. As the shaft 290 rotates, the channels 282 and grooves 294 may align with the piston oil squirter 78 which may cause oil 58 to travel through the channels 282 and the grooves 294 into the piston oil squirter body 84 and out the nozzle 86 into and/or onto the piston 54.

Figure 19:
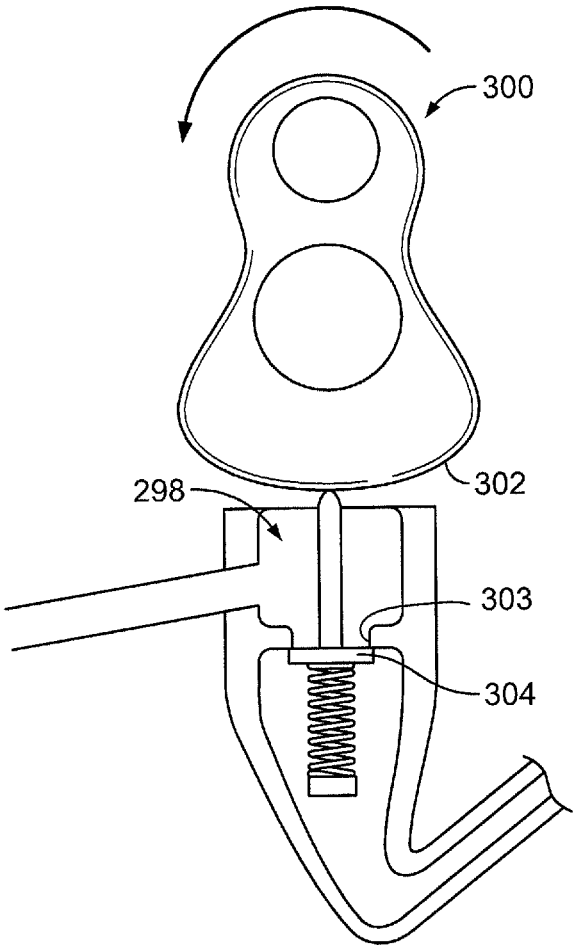
FIG. 19 illustrates a sectional view of a crankshaft counterweight and a mechanical valve pintle according to a number of variations.

Referring to FIG. 19, in another variation, the outer surface 302 of the crankshaft counterweight 300 may be used to actuate a mechanical valve pintle 298 to open the orifice 303 of a valve 304. The crankshaft counter weight 300 may be timed to open the valve 304 at a number of variations including, but not limited to, when the piston 56 approaches bottom dead center 118 (best illustrated in FIG. 7).

A controller system may be provided. The controller system may include a main controller and/or a control subsystem which may include one or more controllers (not separately shown) in communication with the components of the system and/or other components of the vehicle for receiving and processing sensor input and transmitting output signals. The controller(s) may include one or more suitable processors and memory devices (not separately shown). The memory may be configured to provide storage of data and instructions that provide at least some of the functionality of the engine system and that may be executed by the processor(s). At least portions of the method may be enabled by one or more computer programs and various engine system data or instructions, piston operating condition data stored in memory as look-up tables, formulas, algorithms, maps, models, or the like. In any case, the control subsystem may control engine system parameters or parameters of the system by receiving input signals from the sensors, executing instructions or algorithms in light of sensor input signals, and transmitting suitable output signals to the various actuators, and/or components. As used herein, the term "model" may include any construct that represents something using variables, such as a look up table, map, formula, algorithm and/or the like. Models may be application specific and particular to the exact design and performance specifications of any given engine system or of the system. A controller system main controller and/or a control subsystem may include one or more controllers (not separately shown) in communication with the components of the system and/or other components of the vehicle for receiving and processing sensor input and transmitting output signals and may be operatively connected to the solenoids to control the solenoids and the timing of the pistion oil squiters, for example, in a method consistent with the illustrated variations described herein.

It should be noted that although an automotive engine is described for exemplary purposes, the present invention may be used in any number of pistons systems.

The following description of variants is only illustrative of components, elements, acts, products and methods considered to be within the scope of the invention and are not in any way intended to limit such scope by what is specifically disclosed or not expressly set forth. The components, elements, acts, products and methods as described herein may be combined and rearranged other than as expressly described herein and still are considered to be within the scope of the invention.

Variation 1 may include a product comprising: a piston oil squirting system comprising: at least one piston oil squirter operatively communicating with at least one engine oil channel and which is constructed and arranged to squirt oil at at least one piston; and at least one mechanism which is constructed and arranged to control a flow rate and a timing of at least one oil jet stream from the at least one piston oil squirter so that the oil jet stream flows at single or multiple intervals from a zero to a maximum flow rate within an engine cycle or a crankshaft revolution.

Variation 2 may include a product as set forth in Variation 1 wherein the piston oil squirter expels the at least one oil jet stream in a first interval and a second interval during the engine cycle or the crankshaft revolution, and wherein the first interval includes a cycle-average flow rate different than the second interval.

Variation 3 may include a product as set forth in any of Variations 1-2 wherein the at least one piston oil squirter's cycle-averaged flow rate is modulated via duty cycle.

Variation 4 may include a product as set forth in any of Variations 1-3 wherein the at least one piston oil squirter's cycle-averaged flow rate is controlled based on at least one of a load, a revolutions per minute (rpm), or a temperature in a continuous fashion.

Variation 5 may include a product as set forth in any of Variations 1-4 wherein the at least one oil jet stream from the at least one piston oil squirter is aimed at at least one of a piston oil gallery hole or an underside of the at least one piston.

Variation 6 may include a product as set forth in any of Variations 1-5 wherein the at least one mechanism comprises at least one solenoid.

Variation 7 may include a product as set forth in Variation 6 wherein a first solenoid is operatively coupled to at least one first piston oil squirter and at least one second solenoid is operatively coupled to at least one second piston oil squirter.

Variation 8 may include a product as set forth in Variation 6 wherein a first solenoid is operatively coupled to at least one first piston oil squirter, a second solenoid is operatively coupled to at least one second piston oil squirter, and a third solenoid is operatively coupled to at least one third piston oil squirter.

Variation 9 may include a product as set forth in any of Variations 1-6 wherein a first solenoid is operatively coupled to at least one first piston oil squirter, a second solenoid is operatively coupled to at least one second piston oil squirter, a third solenoid is operatively coupled to at least one third piston oil squirter, and a fourth solenoid is operatively coupled to at least one fourth piston oil squirter.

Variation 10 may include a product as set forth in any of Variations 1-6 wherein a first solenoid is operatively coupled to at least one first piston oil squirter, a second solenoid is operatively coupled to at least one second piston oil squirter, a third solenoid is operatively coupled to at least one third piston oil squirter, a fourth solenoid is operatively coupled to at least one fourth piston oil squirter, a fifth solenoid is operatively coupled to at least one fifth piston oil squirter, and a sixth solenoid is operatively coupled to at least one sixth piston oil squirter.

Variation 11 may include a product as set forth in any of Variations 1-6 wherein the at least one mechanism comprises a first solenoid operatively coupled to at least one first piston oil squirter, a second solenoid operatively coupled to at least one second piston oil squirter, a third solenoid operatively coupled to at least one third piston oil squirter, a fourth solenoid operatively coupled to at least one fourth piston oil squirter, a fifth solenoid operatively coupled to at least one fifth piston oil squirter, a sixth solenoid operatively coupled to at least one sixth piston oil squirter, a seventh solenoid operatively coupled to at least one seventh piston oil squirter, and an eighth solenoid operatively coupled to at least one eighth piston oil squirter.

Variation 12 may include a product as set forth in any of Variations 1-5 wherein the at least one mechanism comprises a rotating shaft, wherein the rotating shaft comprises at least one groove which is constructed and arranged to provide oil to the at least one piston oil squirter.

Variation 13 may include a product as set forth in any of Variations 1-5 wherein the at least one mechanism comprises a mechanical valve pintle, and wherein a crankshaft counterweight is used to actuate the mechanical valve pintle to send oil to the at least one piston oil squirter at a desired time.

Variation 14 may include a method comprising: controlling a timing and an instantaneous flow rate of at least one oil jet stream from at least one piston oil squirter so that the oil jet stream flows at a single or at multiple intervals from a zero to a maximum flow rate during an engine cycle and timing the instantaneous flow rate relative to an individual piston position.

Variation 15 may include a method as set forth in Variation 14 wherein a first group of piston oil squirters are operatively connected to a first group of pistons which arrive at top dead center at approximately the same time, and wherein a second group of piston oil squirters are operatively connected to a second group of pistons which arrive at top dead center at the same time, and wherein the timing and instantaneous flow rate of the first group of piston oil squirters are each controlled independently based on a relative position of the first and the second group of pistons.

Variation 16 may include a method as set forth in Variation 14 wherein a first group of piston oil squirters are operatively connected to a first group of pistons which arrive at top dead center at approximately the same time, wherein a second group of piston oil squirters are operatively connected to a second group of pistons which arrive at top dead center at approximately the same time, wherein a third group of piston oil squirters are operatively connected to a third group of pistons which arrive at top dead center at approximately the same time, and wherein the timing and the instantaneous flow rate of the first group of piston oil squirters, the second group of piston oil squirters, and the third group of piston oil squirters are each controlled independently based on a relative position of the first, the second, and the third group of pistons.

Variation 17 may include a method as set forth in Variation 14 wherein a first group of piston oil squirters are operatively connected to a first group of pistons which arrive at top dead center at approximately the same time, wherein a second group of piston oil squirters are operatively connected to a second group of pistons which arrive at top dead center at approximately the same time, wherein a third group of piston oil squirters are operatively connected to a third group of pistons which arrive at top dead center at approximately the same time, and a fourth group of piston oil squirters are operatively connected to a fourth group of pistons which arrive at top dead center at approximately the same time, and wherein the timing and the instantaneous flow rate of the first group of piston oil squirters, the second group of piston oil squirters, the third group of piston oil squirters, and the fourth group of piston oil squirters are each controlled independently based on a relative position of the first, the second, the third, and the fourth group of pistons.

Variation 18 may include a method as set forth in Variation 14 wherein a first group of piston oil squirters are operatively connected to a first group of pistons which arrive at top dead center at approximately the same time, wherein a second group of piston oil squirters are operatively connected to a second group of pistons which arrive at top dead center at approximately the same time, wherein a third group of piston oil squirters are operatively connected to a third group of pistons which arrive at top dead center at approximately the same time, a fourth group of piston oil squirters are operatively connected to a fourth group of pistons which arrive at top dead center at approximately the same time, a fifth group of piston oil squirters are operatively connected to a fifth group of pistons which arrive at top dead center at approximately the same time, and a sixth group of piston oil squirters operatively connected to a sixth group of pistons which arrive at top dead center at approximately the same time, and wherein the timing and the instantaneous flow rate of the first group of piston oil squirters, the second group of piston oil squirters, the third group of piston oil squirters, the fourth group of piston oil squirters, the fifth group of piston oil squirters, and the sixth group of piston oil squirters are each controlled independently based on a relative position of the first, the second, the third, the fourth, the fifth, and the sixth group of pistons.

Variation 19 may include a method as set forth in Variation 14 wherein a first group of piston oil squirters are operatively connected to a first group of pistons which arrive at top dead center at approximately the same time, wherein a second group of piston oil squirters are operatively connected to a second group of pistons which arrive at top dead center at approximately the same time, wherein a third group of piston oil squirters are operatively connected to a third group of pistons which arrive at top dead center at approximately the same time, a fourth group of piston oil squirters are operatively connected to a fourth group of pistons which arrive at top dead center at approximately the same time, a fifth group of piston oil squirters are operatively connected to a fifth group of pistons which arrive at top dead center at approximately the same time, a sixth group of piston oil squirters operatively connected to a sixth group of pistons which arrive at top dead center at approximately the same time, a seventh group of piston oil squirters operatively connected to a seventh group of pistons which arrive at top dead center at approximately the same time, and an eighth group of piston oil squirters operatively connected to an eighth group of pistons which arrive at top dead center at approximately the same time, and wherein the timing and instantaneous flow rate of the first group of piston oil squirters, the second group of piston oil squirters, the third group of piston oil squirters, the fourth group of piston oil squirters, the fifth group of piston oil squirters, the sixth group of piston oil squirters, the seventh group of piston oil squirters, and the eighth group of piston oil squirters are each controlled independently based on a relative position of the first, the second, the third, the fourth, the fifth, the sixth, the seventh, and the eighth group of pistons.

Variation 20 may include a product comprising: an integrated piston oil squirter comprising: a body, a nozzle operatively coupled to the body, and a solenoid integrated into the body.

The above description of select variations within the scope of the invention is merely illustrative in nature and, thus, variations or variants thereof are not to be regarded as a departure from the spirit and scope of the invention.

What is claimed is:

1. A product comprising:

a piston oil squirting system comprising:

a piston;

a piston oil squirter having a nozzle; an engine oil channel delivering oil to the oil squirter the oil squirter constructed and arranged to squirt an oil jet stream through the nozzle and at the piston;

an engine crankshaft operating through a number of repeating engine cycles; and a mechanism through which an orifice is formed, the orifice alternatively open or closed, the orifice supplying the oil jet stream when open, and the orifice being open for a first interval when the crankshaft is in a first position during one engine cycle, and the orifice being open for a second interval when the crankshaft is in a second position during the one engine cycle, the second position different from the first position and the orifice being closed when the crankshaft is positioned between the first position and the second position, providing multiple intervals of the oil jet stream during the one engine cycle.

2. The product of claim 1 further comprising an engine camshaft, wherein the oil jet stream is expelled in the first interval and in the second interval during the engine cycle or a crankshaft revolution, wherein the orifice includes a first channel in the engine camshaft and a second channel in the engine camshaft, wherein the first interval is provided through the first channel and the second interval is provided through the second channel, and wherein the first interval includes a cycle-average flow rate different than the second interval.

3. The product of claim 1 wherein a piston oil squirter's cycle-averaged flow rate is modulated via a duty cycle, wherein the duty cycle is a percent open time of the orifice over one engine cycle.

4. The product of claim 1 wherein the orifice is opened to provide a cycle-averaged flow rate that is controlled based on at least one of a load, a revolutions per minute (rpm), or a temperature in a continuous fashion.

5. The product of claim 1 wherein the oil jet stream from the piston oil squirter is aimed at a piston oil gallery hole in the piston, when the piston is approximately at a bottom dead center position.

6. The product of claim 1 wherein the mechanism comprises a solenoid, and comprising a second oil squirter wherein the solenoid includes the orifice that is connected with both oil squirters and supplies the oil jet stream to both oil squirters through the orifice.

7. The product of claim 6 further comprising a V8 engine with two side-by-side rows of four cylinders wherein the solenoid is operatively coupled to one of the cylinders in each of the rows.

8. The product of claim 6 further comprising a V8 engine with two side-by-side rows of four cylinders wherein the solenoid is operatively coupled to two of the cylinders in one of the rows.

9. The product of claim 1 wherein the piston defines an oil gallery with an inlet channel, an outlet channel separated from the inlet channel, and a body channel extending between the inlet channel and the outlet channel.

10. The product of claim 9 wherein the outlet channel is disposed at an angle directed downward and inward toward a center of the piston.

11. The product of claim 1 further comprising an engine camshaft that operates in conjunction with the piston, wherein the orifice comprises a channel in the engine camshaft.

12. The product of claim 11 wherein the engine camshaft includes an oil feed opening extending through the engine camshaft that intersects the channel.

13. The product of claim 1 wherein the mechanism comprises a rotating shaft, wherein the rotating shaft comprises at least one groove which is constructed and arranged to provide oil to the piston oil squirter, wherein the rotating shaft is an engine camshaft.

14. The product of claim 1 wherein the mechanism comprises a mechanical valve pintle, and wherein a crankshaft counterweight is used to actuate the mechanical valve pintle to send oil to the piston oil squirter at a desired time.

15. The product of claim 1 wherein a timing and an instantaneous flow rate of the oil jet stream from the piston oil squirter is controllable so that the oil jet stream flows at a single or at multiple intervals from a zero to a maximum flow rate during the engine cycle and timing the instantaneous flow rate relative to an individual piston position.

16. The product of claim 15 wherein a first group of piston oil squirters are operatively connected to a first group of pistons wherein the first group of pistons arrive at top dead center approximately together, and wherein a second group of piston oil squirters are operatively connected to a second group of pistons wherein the second group of pistons arrive at top dead center approximately together, and wherein the timing and instantaneous flow rate of the first group of piston oil squirters are each controllable independently based on a relative position of the first and the second group of pistons.

17. The product of claim 15 wherein a first group of piston oil squirters are operatively connected to a first group of pistons wherein the first group of pistons arrive at top dead center approximately together, wherein a second group of piston oil squirters are operatively connected to a second group of pistons wherein the second group of pistons arrive at top dead center approximately together, wherein a third group of piston oil squirters are operatively connected to a third group of pistons wherein the third group of pistons arrive at top dead center approximately together, and wherein the timing and the instantaneous flow rate of the first group of piston oil squirters, the second group of piston oil squirters, and the third group of piston oil squirters are each controlled independently based on a relative position of the first, the second, and the third group of pistons.

18. The product of claim 15 wherein a first group of piston oil squirters are operatively connected to a first group of pistons wherein the first group of pistons arrive at top dead center approximately together, wherein a second group of piston oil squirters are operatively connected to a second group of pistons wherein the second group of pistons arrive at top dead center approximately together, wherein a third group of piston oil squirters are operatively connected to a third group of pistons wherein the third group of pistons arrive at top dead center approximately together, and a fourth group of piston oil squirters are operatively connected to a fourth group of pistons wherein the fourth group of pistons arrive at top dead center approximately together, and wherein the timing and the instantaneous flow rate of the first group of piston oil squirters, the second group of piston oil squirters, the third group of piston oil squirters, and the fourth group of piston oil squirters are each controlled independently based on a relative position of the first, the second, the third, and the fourth group of pistons.

19. The product of claim 15 wherein a first group of piston oil squirters are operatively connected to a first group of pistons wherein the first group of pistons arrive at top dead center approximately together, wherein a second group of piston oil squirters are operatively connected to a second group of pistons wherein the second group of pistons arrive at top dead center approximately together, wherein a third group of piston oil squirters are operatively connected to a third group of pistons wherein the third group of pistons arrive at top dead center approximately together, a fourth group of piston oil squirters are operatively connected to a fourth group of pistons wherein the fourth group of pistons arrive at top dead center approximately together, a fifth group of piston oil squirters are operatively connected to a fifth group of pistons wherein the fifth group of pistons arrive at top dead center approximately together, and a sixth group of piston oil squirters operatively connected to a sixth group of pistons wherein the sixth group of pistons arrive at top dead center approximately together, and wherein the timing and the instantaneous flow rate of the first group of piston oil squirters, the second group of piston oil squirters, the third group of piston oil squirters, the fourth group of piston oil squirters, the fifth group of piston oil squirters, and the sixth group of piston oil squirters are each controlled independently based on a relative position of the first, the second, the third, the fourth, the fifth, and the sixth group of pistons.

20. The product of claim 15 wherein a first group of piston oil squirters are operatively connected to a first group of pistons wherein the first group of pistons arrive at top dead center approximately together, wherein a second group of piston oil squirters are operatively connected to a second group of pistons wherein the second group of pistons arrive at top dead center approximately together, wherein a third group of piston oil squirters are operatively connected to a third group of pistons wherein the third group of pistons arrive at top dead center approximately together, a fourth group of piston oil squirters are operatively connected to a fourth group of pistons wherein the fourth group of pistons arrive at top dead center approximately together, a fifth group of piston oil squirters are operatively connected to a fifth group of pistons wherein the fifth group of pistons arrive at top dead center approximately together, a sixth group of piston oil squirters operatively connected to a sixth group of pistons wherein the sixth group of pistons arrive at top dead center approximately together, a seventh group of piston oil squirters operatively connected to a seventh group of pistons wherein the seventh group of pistons arrive at top dead center approximately together, and an eighth group of piston oil squirters operatively connected to an eighth group of pistons wherein the eighth group of pistons arrive at top dead center approximately together, and wherein the timing and instantaneous flow rate of the first group of piston oil squirters, the second group of piston oil squirters, the third group of piston oil squirters, the fourth group of piston oil squirters, the fifth group of piston oil squirters, the sixth group of piston oil squirters, the seventh group of piston oil squirters, and the eighth group of piston oil squirters are each controlled independently based on a relative position of the first, the second, the third, the fourth, the fifth, the sixth, the seventh, and the eighth group of pistons.

21. A product comprising:

an engine block defining a number of piston bores wherein each bore has a bottom, the engine block having a pair of bulkheads each positioned between a pair of adjacent piston bores;

a piston positioned in one of the piston bores;

an integrated piston oil squirter comprising:

a body, a nozzle operatively coupled to the body, and a solenoid integrated into the body;

the piston oil squirter positioned entirely under the engine block adjacent the bottom of the bore and between the pair of bulkheads, the nozzle extending under the piston, and a crankshaft operating through a number of repeating engine cycles, wherein the solenoid is alternatively open or closed, the solenoid supplying an oil jet stream through the nozzle when open, and an orifice being open for a first interval when the crankshaft is in a first position during one engine cycle, and the orifice being open for a second interval when the crankshaft is in a second position during the one engine cycle, the second position different from the first position and the orifice being closed when the crankshaft is positioned between the first position and the second position, the solenoid providing multiple intervals of the oil jet stream during the one engine cycle.

22. The product of claim 12 wherein the engine camshaft includes a groove at its outer surface that intersects the channel and that extends around a part of a perimeter of the engine camshaft.

* * * * *